United States Patent [19]

Herbert

[11] Patent Number: 4,526,284

[45] Date of Patent: Jul. 2, 1985

[54] PLASTIC CLOSURE WITH SEALING FIN

[75] Inventor: James F. Herbert, Cheslyn Hay, England

[73] Assignee: Metal Closures Limited, West Midlands, England

[21] Appl. No.: 648,029

[22] Filed: Sep. 7, 1984

[30] Foreign Application Priority Data

Oct. 19, 1983 [GB] United Kingdom ..... 8327991

[51] Int. Cl.[3] ..... B65D 53/00

[52] U.S. Cl. ..... 215/329; 215/344; 215/DIG. 1

[58] Field of Search ..... 215/344, DIG. 1, 329

[56] References Cited

U.S. PATENT DOCUMENTS 4,072,244 2/1978 Mueller ..... 215/DIG. 1

FOREIGN PATENT DOCUMENTS 1107541 10/1959 Fed. Rep. of Germany ... 215/DIG. 1

*Primary Examiner*—Donald F. Norton

*Attorney, Agent, or Firm*—Roland T. Bryan

[57] ABSTRACT

A closure for a container comprises a top 11 with a depending skirt 12 having an internal screw thread. Where the skirt joins the top, the internal surface 15 of the skirt is conically flared in a direction away from the top, and a flexible resilient fin 18 extends from the underside of the top substantially parallel to the flared surface 15. The free end portion of the fin is thickened as by the provision of a broad rib 23 on the radially inner surface of the fin. When the closure is secured on to a container, the fin 18 becomes defirmed outward and is sufficiently long to extend round the outer corner portion of the top of the container and is pressed into tight sealing engagement with said outer corner portion by the flared surface. The increased thickness of the free end portion of the fin causes it to resist expansion and to hug more closely the corner portion of the top of the container. The radially inner surface of the fin may have annular grooves therein, for example of triangular shape, to provide a ribbed surface to improve the seal.

7 Claims, 5 Drawing Figures

PLASTIC CLOSURE WITH SEALING FIN

This invention relates to container closures.

According to this invention there is provided a container closure moulded in one piece from a plastics material and comprising a top, a circumferentially extending skirt depending from the top and having a radially inner surface formed with a screwthread, a surface which is flared in a direction away from the top being formed on the internal surface of the skirt where it joins the top, and an annular resiliently flexible fin extending from the underside of the top at a position spaced radially inwardly of said flared surface, said fin having a main body which has an increasing diameter in a direction away from the top and having a free end portion which is thicker than said main body, said fin having a length such as to permit at least its portion adjoining said free end to lie against said flared surface when the fin is deformed outwardly by the top of the neck of a container to which the closure is to be applied.

In preferred arrangements said flared surface is conical. The flared surface may for example be inclined at 30° to the central axis of the closure. The fin may conveniently also be conical and may extend parallel to said flared surface.

The free end portion may for example be thickened as aforesaid by the provision of a peripheral rib formed locally of either the radially inner surface or the radially outer surface of said free end portion. The thickening of the free end portion serves to reduce the tensile stress in the fin when the closure is applied and in consequence to reduce the degree of extension of the free end portion of the fin so that a greater part of the length of the fin tends to hug the outer corner portion of the neck more closely and thus improves the seal. Where for this purpose a peripheral rib is formed on the radially inner surface of the fin, the rib may itself form with the neck of the container an additional line seal about the neck. Similarly where the rib is on the radially outer surface of the fin, the flared surface may engage the rib and press the free end portion of the fin towards the neck of the container.

The radially inner surface of the fin may have a plurality of annular grooves formed therein, each pair of adjacent grooves defining between them an annular rib of triangular cross-section. The grooves may be triangular and of buttress section, and the buttress face of the groove may face towards or away from the top to form a rib or ribs suitable for use with containers for materials under vacuum or under pressure, or may be of other triangular shape such as isosceles or equilateral triangular shape or of e.g. circular or rectangular form to form a rib or ribs of other required cross-sectional shape.

An embodiment of the invention will now be described in more detail with reference to the accompanying drawings in which.

Figure 1:
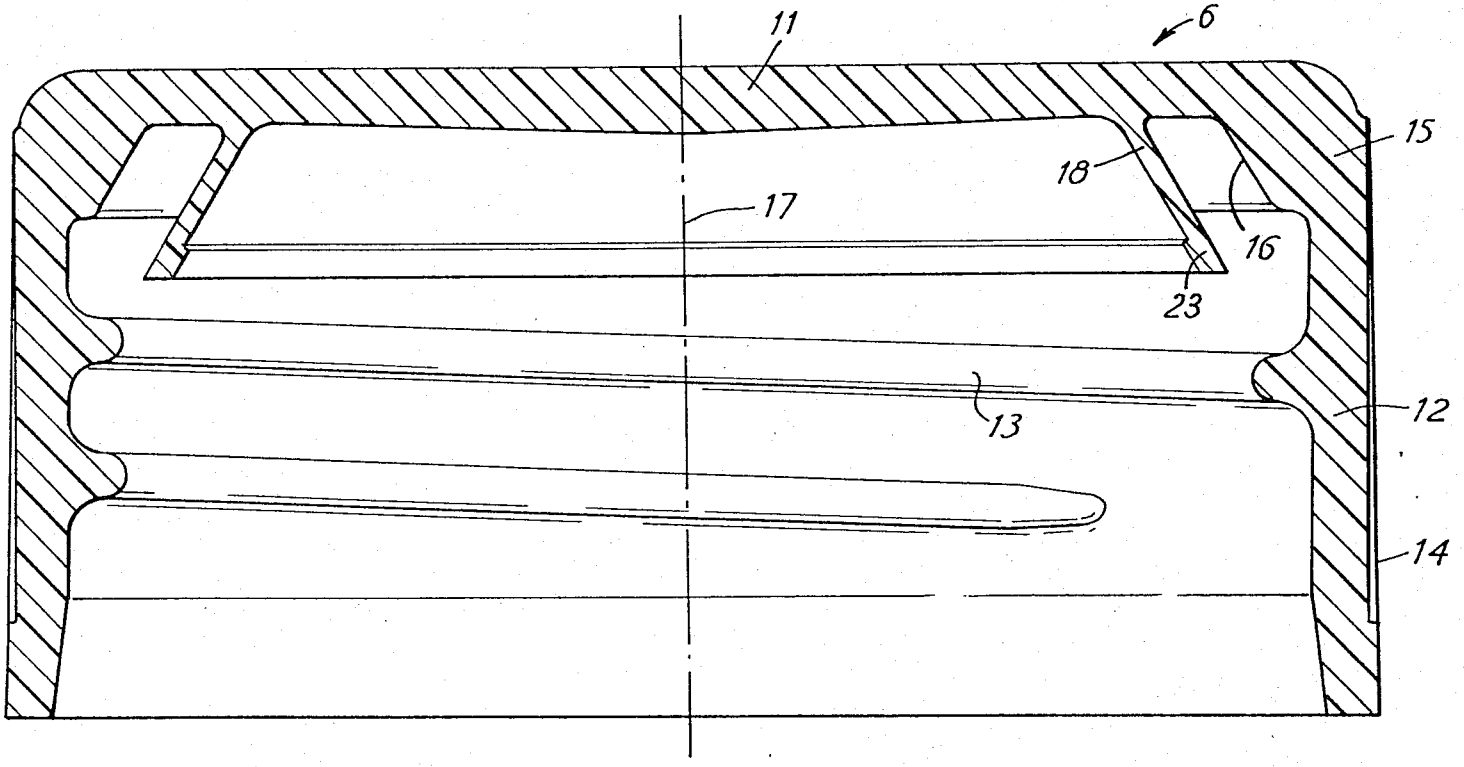
FIG. 1 shows in axial section a first form of closure according to the invention.

Referring first to FIG. 1, the closure 10 is moulded in one piece from a resilient plastics material and has a top 11 and a dependent skirt 12 formed with an internal screw-thread 13 and external knurling 14. The thickness of the top increases gradually towards the centre. The corner region 15 at the upper end of the skirt is thickened and has a conically flared internal surface 16 extending at an angle of 30° to the central axis 17 of the closure. Spaced radially inwardly of the surface 16 is a flexible resilient annular fin 18 extending from the underside of the top and substantially parallel to the surface 16. The fin 18 has a main body of uniform thickness but has its free end portion of the fin thickened by reason of the formation of a broad flat-topped rib 23 on the radially inner surface of the end portion.

Figure 2:
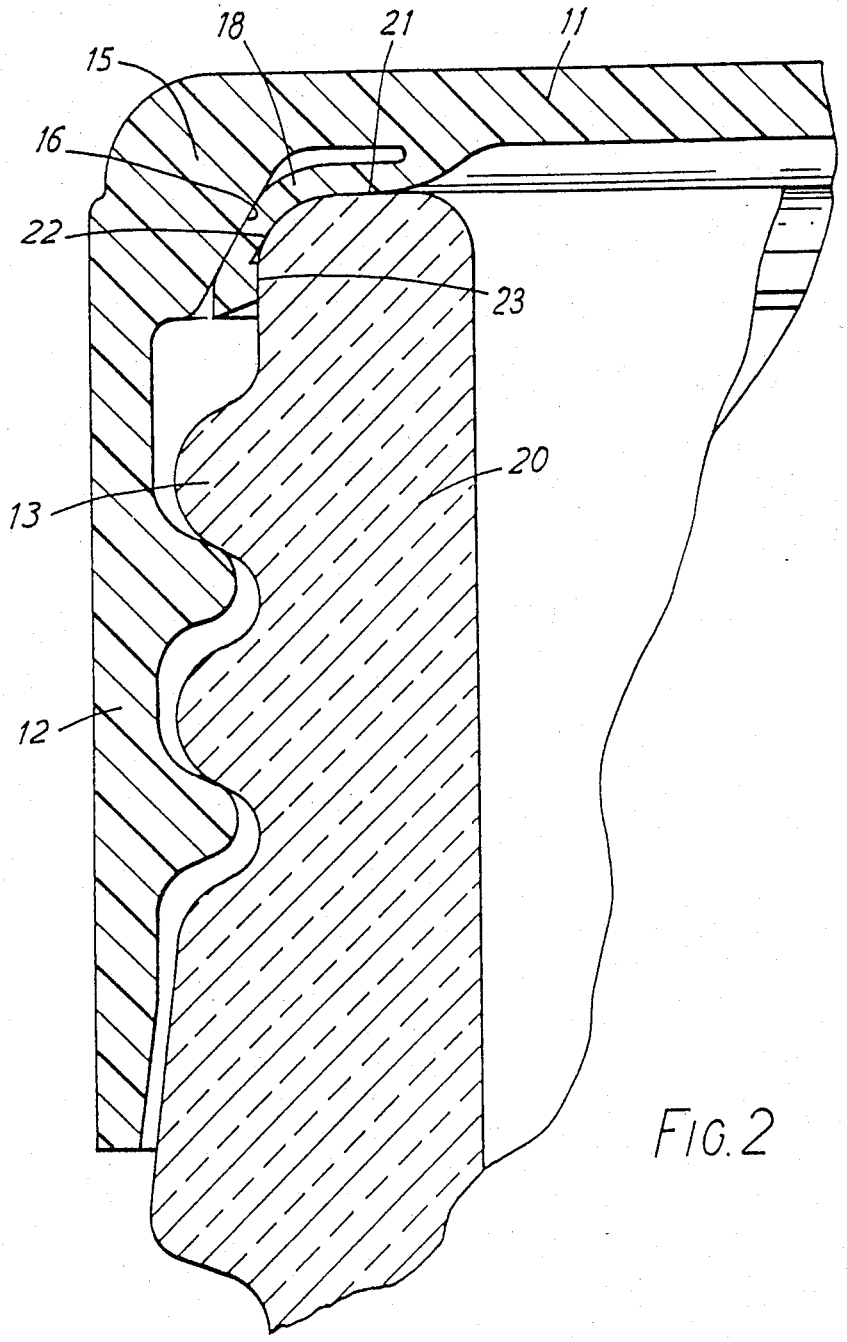
FIGS. 2 and 3 illustrate how the closure of FIG. 1 fits on containers on the upper and lower limits respectively of diametral tolerance.
Figure 3:
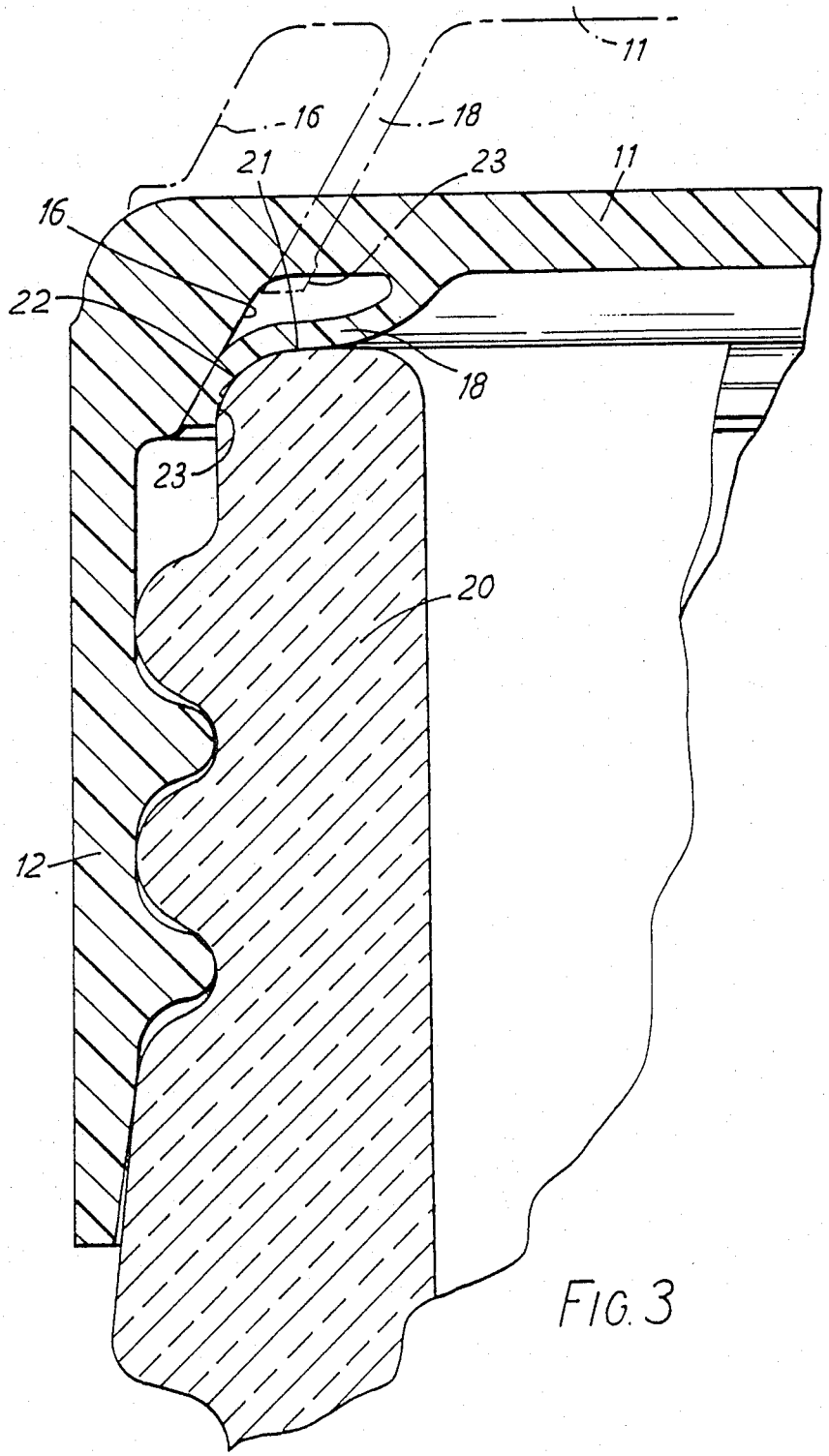

FIGS. 2 and 3 show the closure applied to a screw-threaded container neck 20, the diameters of which are at the lower and upper limits of the tolerance, and FIG. 7 also shows the sealing fin in its unstressed condition extending parallel to the flared surface 16. When the closure is applied to the neck 20 of a container the top 21 of the neck deforms the fin 18 upward so that it lies across and against at least the radially outer portions of the top 21 of the container neck and has a sufficient length in contact with the surface 16 to be pressed thereby against the outer corner portion 22 of the neck to form a top and corner seal. The axial length of the surface 15 and the length of the fin are also such that this sealing engagement takes place when the diameter of the container neck is on the upper limit of its tolerance as shown in FIG. 2 or on the lower limit of its tolerance as shown in FIG. 3.

The rib 23 serves to strengthen the free end portion of the fin so that the diametral strain in that portion, due to the outward flexing of the fin by the top and outer corner parts of the neck, is less than if the rib were absent, and in consequence the end portion of the fin tends to lie closer to the neck even when, as in FIG. 2, it is not constrained by the surface 16 to do so.

Figure 4:
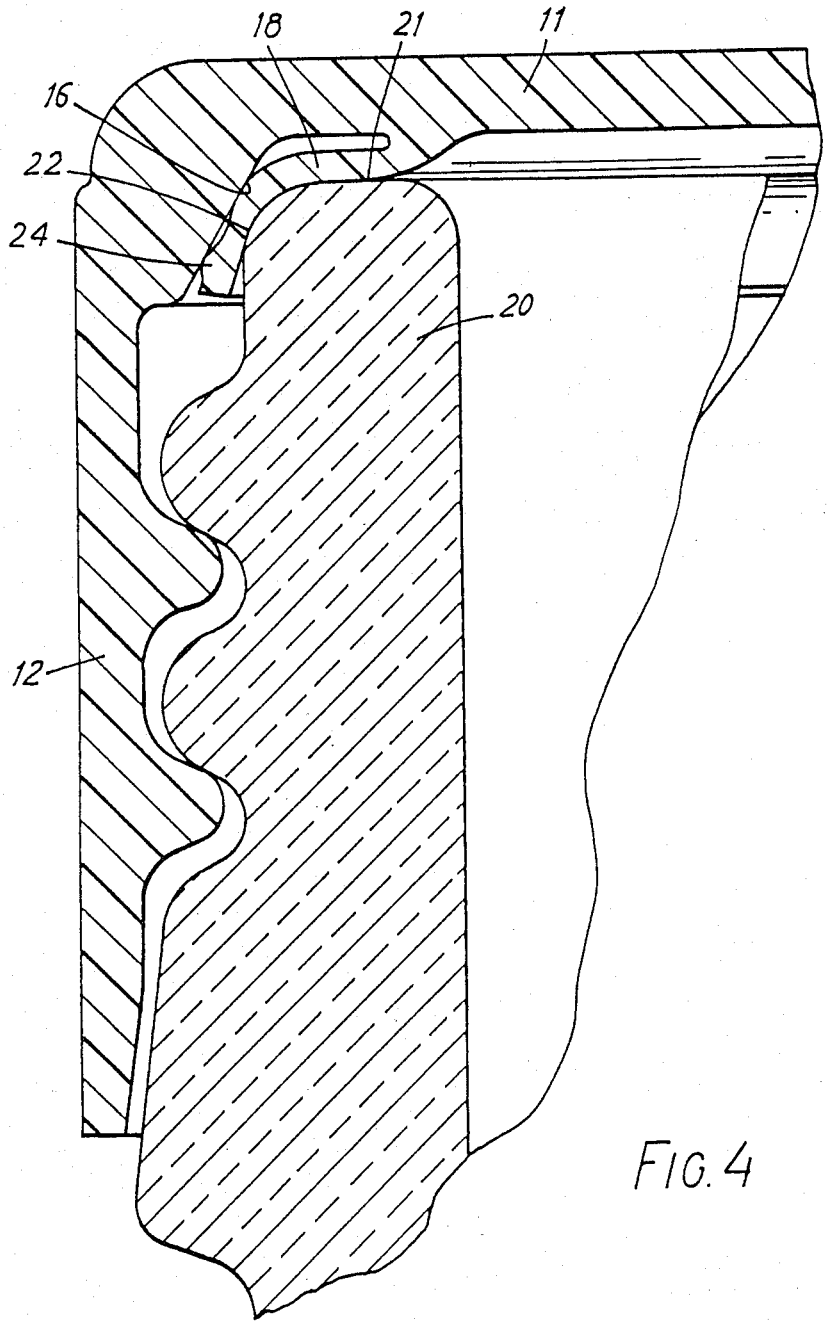
FIGS. 4 and 5 are views corresponding to FIGS. 2 an 3 of a second form of closure according to the invention.
Figure 5:
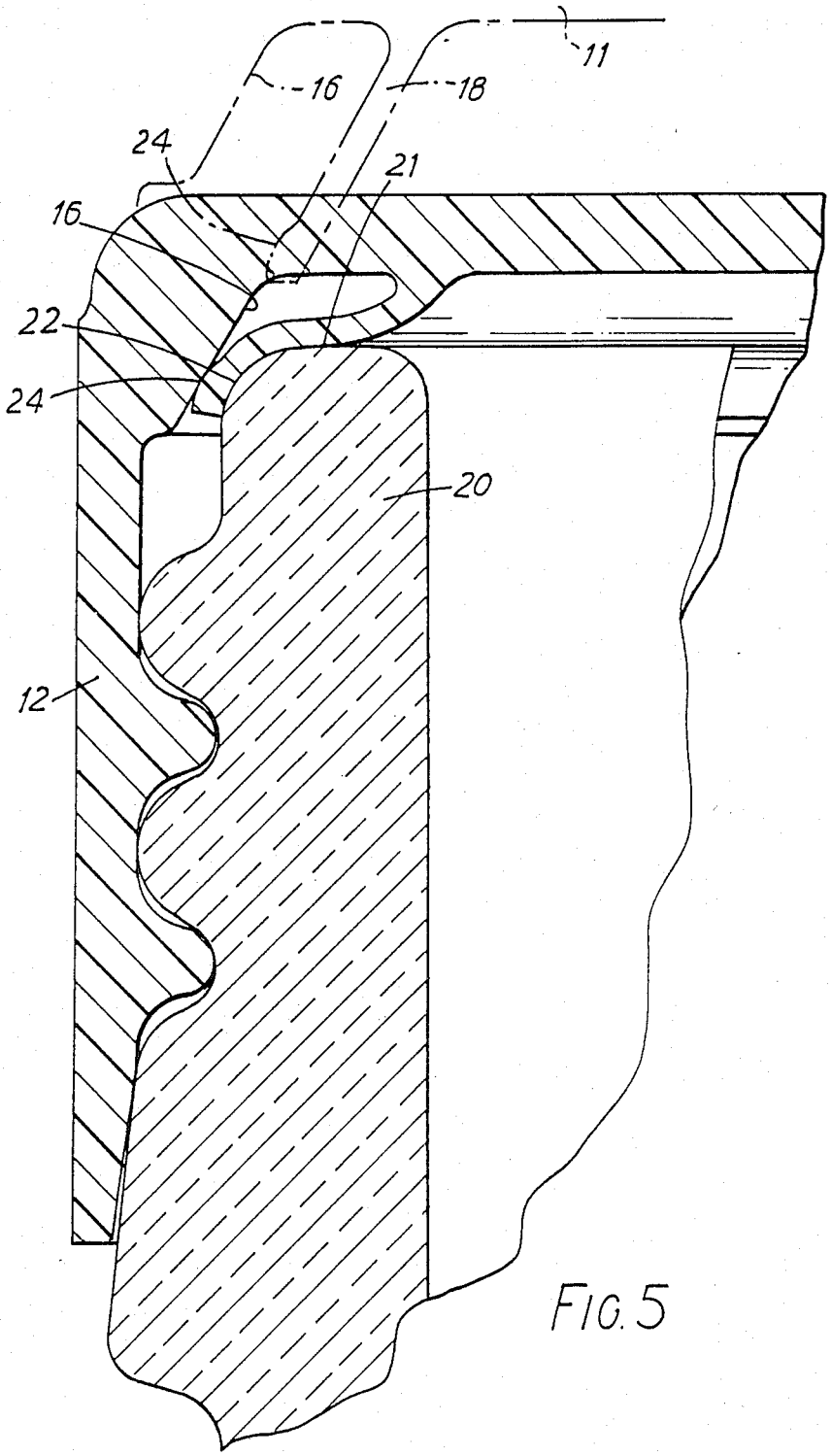

The construction shown in FIGS. 4 and 5 is similar to that in FIGS. 1 to 3, but in FIGS. 4 and 5 the thickening of the free end portion of the fin is achieved by forming a rib 24 having a curved profile on the radially outer surface of the fin 18. FIGS. 4 and 5 show the closure applied to container necks on the lower and higher limits respectively of the diametral tolerance. As in the construction of FIGS. 1 to 3 the thickening of the free end portion of the fin strengthens it locally and causes it to be stretched to a lesser extent, but the surface 16 engages the rib 24 and presses the free end portion of the fin radially inward so as further to improve the seal.

The fin may have a thickness of the order of 0.63 mm (0.025").

The closure of the invention may be used with either glass or plastic containers which are intended to contain still or carbonated liquids or materials under partial vacuum.

I claim:

1. A container closure moulded in one piece from a plastics material and comprising a top, a circumferentially extending skirt depending from the top and having a radially inner surface formed with a screw-thread, a surface which is flared in a direction away from the top being formed on the internal surface of the skirt where it joins the top, and an annular resiliently flexible fin extending from the underside of the top at a position spaced radially inwardly of said flared surface, said fin having a main body which has an increasing diameter in a direction away from the top and having a free end portion which is thicker than said main body, said fin having a length such as to permit at least its portion adjoining said free end to lie against said flared surface when the fin is deformed outwardly by the top of the neck of a container to which the closure is to be applied.

2. A closure as claimed in claim 1, wherein a peripheral rib is formed locally on the radially outer surface of said free end portion of the fin, whereby the free end portion is made thicker than said main body of the fin.

3. A closure as claimed in claim 1, wherein said flared surface is conical.

4. A closure as claimed in claim 3, wherein said flared surface extends at an angle of 30° to the central axis of the closure.

5. A closure as claimed in claim 1, wherein the fin is of conical form.

6. A closure as claimed in claim 3, wherein the fin extends parallel to the flared surface.

7. A closure as claimed in claim 1 wherein main body of the fin is of substantially uniform thickness.

* * * * *